US005297915A

United States Patent [19]

Bach

[11] Patent Number: 5,297,915

[45] Date of Patent: Mar. 29, 1994

[54] APPARATUS FOR LIFTING AND MOVING HEAVY OBJECTS

[76] Inventor: Francis L. Bach, P.O. Box 40, Custer City, Okla. 73639

[21] Appl. No.: 790,942

[22] Filed: Nov. 12, 1991

[51] Int. Cl.[5] ..... B66F 5/04

[52] U.S. Cl. ..... 414/590; 248/676; 269/17

[58] Field of Search ..... 414/589, 590, 10, 11, 414/12, 908; 248/647, 669, 676; 269/17; 254/93, 2, DIG. 4

[56] References Cited

U.S. PATENT DOCUMENTS

| | | | |
|---|---|---|---|
| 2,643,779 | 6/1953 | Hamlin . | |
| 3,281,118 | 10/1966 | Krilanovich | 414/590 |
| 3,750,254 | 8/1973 | Krajcik | 29/200 |
| 3,923,167 | 12/1975 | Blankenbeckler | 414/11 |
| 3,937,443 | 2/1976 | Durgan | 254/10 |
| 3,958,793 | 5/1976 | Garate | 254/10 |
| 4,239,196 | 12/1980 | Hanger | 269/17 |
| 4,300,751 | 11/1981 | Delaney | 254/2 R |
| 4,531,720 | 7/1985 | Soder | 414/11 X |
| 4,549,722 | 10/1985 | Gagliano | 254/134 |
| 4,691,904 | 9/1987 | Armstrong | 269/17 |
| 4,830,335 | 5/1989 | Schlitt | 269/17 |
| 5,033,716 | 7/1991 | Symon | 254/8 B |

*Primary Examiner*—Michael S. Huppert
*Assistant Examiner*—Donald W. Underwood
*Attorney, Agent, or Firm*—Dunlap, Codding & Lee

[57] ABSTRACT

A jack for lifting and moving heavy truck parts, such as clutch assemblies and fly wheels. A hydraulic cylinder assembly is mounted on a wheeled frame for pivotal movement through an arc of greater than 90 degrees so that an object secured to the end of the rod of the cylinder can be moved from a horizontal position, where it rests low in the frame, to a vertical position tilted slightly forward for easy placement or removal of the object under the truck. When the cylinder is in the vertical position and the rod is slightly extended, the object may be rotated in a horizontal plane which assists in positioning the object under the truck. Yet, means is included for limiting the range of such rotation when the rod is completely retracted so that while the object is being lifted up or down it will not swing around the rod and fall off of the apparatus. While secured to the end of the rod of the first cylinder, the object may be rotated in a plane parallel to the axis of the rod. This further assists in positioning the object under the truck. A second hydraulic cylinder is employed to drive the pivotal movement of the first cylinder. In this way, the first cylinder may be selectively positioned at any point throughout the range of rotation.

15 Claims, 3 Drawing Sheets

APPARATUS FOR LIFTING AND MOVING HEAVY OBJECTS

FIELD OF THE INVENTION

The present invention relates generally to devices for lifting and moving objects and in particular to devices for lifting and moving heavy truck parts, such as clutches and flywheels.

SUMMARY OF THE INVENTION

The present invention comprises an apparatus for moving and lifting an object over a surface. The apparatus comprises a wheeled frame and an elongate support member having an upper portion and a lower portion. The lower portion of the support member is attached to the frame for pivotal movement of the support member in a vertical plane between a first position in which the support member is generally horizontal and a second position in which the support member is generally vertical. Means is provided for securing the object to the upper portion of the support member. The upper portion and the lower portion of the support member are constructed so that the upper portion may be retracted and extended relative to the lower portion whereby the length of the support member is decreased and increased for raising and lowering the object. Also included is means for driving the retraction and extension of the upper portion relative to the lower portion of the support member. The apparatus further comprises means for driving the pivotal movement of the support member relative to the frame and for selectively positioning the support member at any point between the first position and the second position.

In another aspect, the apparatus of the present invention comprises a wheeled base and a support member. The support member has an upper and a lower portion. The lower portion of the support member is attached to the frame for pivotal movement of the support member between a first position in which the support member is generally horizontal and a second position in which the support member is generally vertical. The apparatus includes means for securing the object to the upper portion of the support member and this securing means is characterized as permitting an object positioned on the upper portion to be rotated in a plane generally perpendicular to the longitudinal axis of the support member. The upper and lower portion of the support member are connected to each other in a manner that permits the upper portion to be retracted and extended relative to the lower portion whereby the length of the support member is decreased and increased for raising and lowering the object. Means for driving such retraction and extension and means for driving the pivotal movement of the support member also are included.

In yet another aspect, the apparatus of the present invention comprises a wheeled base having attached thereto a first hydraulic cylinder assembly comprising a rod and a cylinder. The cylinder of the first hydraulic cylinder assembly is pivotally attached to the frame for selective movement in a vertical plane between a first position in which the cylinder is substantially horizontal and a second position in which the cylinder is substantially vertical. Means is included for securing the object to the free end of the rod of the first hydraulic cylinder assembly. This securing means is characterized as permitting the object secured thereby to be rotated in a plane generally parallel to the longitudinal axis of the rod and in a plane generally perpendicular to the longitudinal axis of the rod. When the first hydraulic cylinder assembly is in a generally vertical position, the rod of the first hydraulic cylinder assembly can be extended and retracted to raise and lower the object secured thereto. The apparatus further includes a second hydraulic cylinder assembly for driving the movement of the first hydraulic cylinder assembly between the first position and the second position and for selectively positioning the first hydraulic cylinder assembly at any point therebetween.

DETAILED DESCRIPTION OF THE PREFERRED EMBODIMENT

In the servicing and repair of large trucks it is often necessary to remove and repair or replace large parts from under the truck, such as the clutch assembly and the flywheel. A typical clutch assembly weighs about 150 pounds and is about 17 inches wide and 6 inches deep. The task of lifting and moving such parts is further complicated by the fact that the space under the cab of the truck where this must be carried out is severely limited. In most instances the space is no more than about 48 inches high, as the floor of the cab usually is not removed in order to access the clutch. This space is only about thirty inches wide as it is limited on the sides by the side members of the truck frame.

Due to these circumstances, the removal and replacement of these parts has long been a difficult and hazardous undertaking. The apparatus of the present invention makes greatly reduces the danger and difficulty of working under these conditions.

Figure 1:
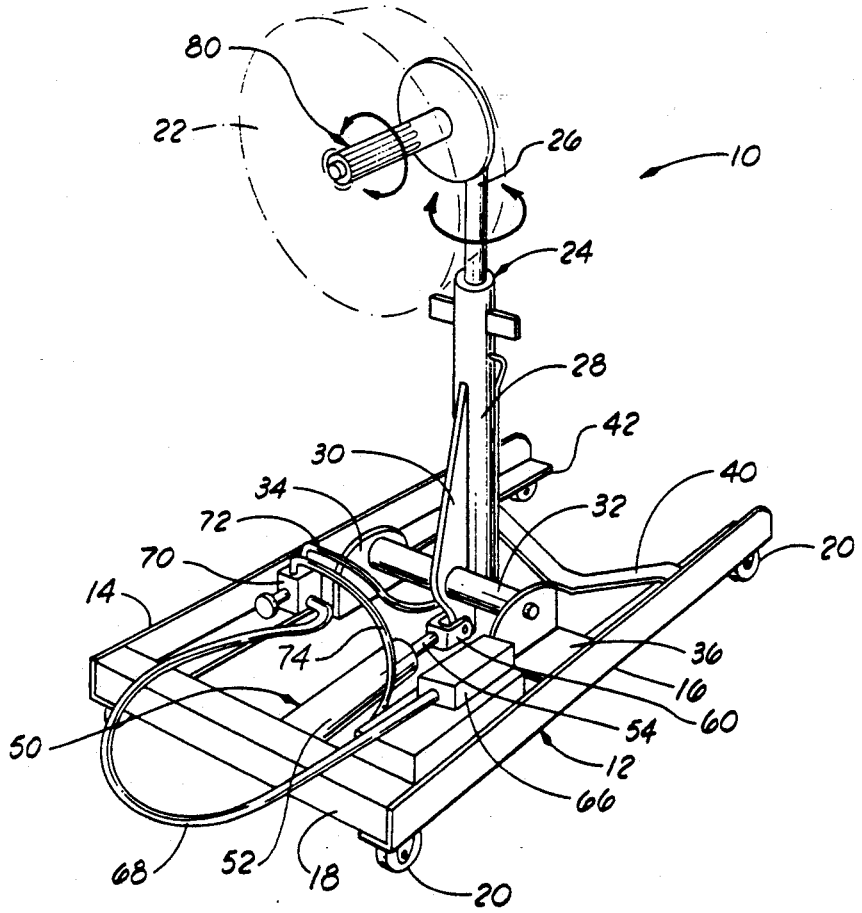
FIG. 1 is a perspective view of the lifting and moving apparatus of the present invention. The position of a clutch assembly secured to the apparatus is shown in phantom lines. The support member of the apparatus is shown in a vertical position.
Figure 2:
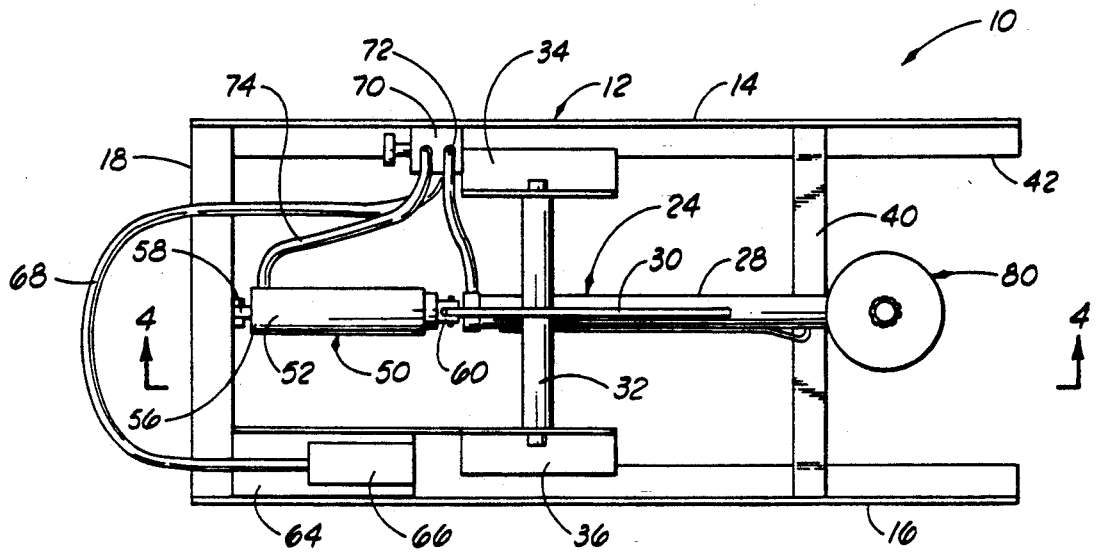
FIG. 2 is a plan view of the apparatus (not including an object supported thereon). The support member is shown in the horizontal position.

Turning now to the drawings in general and to FIGS. 1 and 2 in particular, there is shown therein an apparatus constructed in accordance with the present invention for lifting and moving heavy objects. While the apparatus shown and described herein is adapted for use in installing and removing heavy truck parts, it will be appreciated that the present invention has many other applications.

The apparatus, designated generally by the reference numeral 10, comprises a frame 12 of sturdy, rigid construction preferably in U-shaped arrangement. The frame 12 may be formed by a pair of legs 14 and 16 extending from an end member 18. The end member 18 may be of square tubular metal and the legs 14 and 16 of 4" by 4" angle iron. Thus, the frame 12 generally defines a plane which is parallel to the surface. The structural components of the frame may be secured together by welding or some other suitable method.

The width of the frame 12, which in this embodiment is defined by the end 18, preferably is about 22 inches. The length, which in this embodiment is defined generally by the legs 14 and 16, preferably is about 36 inches. These dimensions provide a frame that maneuvers easily under and between the frame of a large truck.

As it is necessary that the frame be movable, the frame is provided with wheels of some sort. Castors 20 are preferred as these provided good swivel action.

For holding the object 22 on the apparatus 10, the apparatus comprises an elongate support member having an upper portion and a lower portion. In the preferred embodiment the support member is a first hydraulic cylinder assembly 24. Thus, the upper portion of the assembly is the rod 26 of the cylinder assembly 24 and the lower portion is the cylinder 28.

The cylinder 28 of the first hydraulic cylinder assembly 24 is attached to the frame 12 for pivotal movement of the first hydraulic cylinder assembly 24 in a vertical plane. For this purpose, a fin 30 is attached to the cylinder 28, and this fin is mounted on a cross bar 32 supported midway on the length of the frame 12 by L-shaped members 34 and 36.

Figure 3:
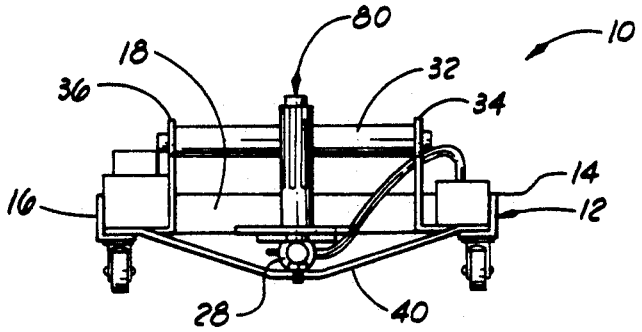
FIG. 3 is an end elevational view of apparatus.

The range of rotation of the cylinder 28 is limited horizontally by a cradle 40. The cradle 40 preferably is a flat, V-shaped strap of metal welded near the open or first end 42 of the frame 12. As best seen in FIG. 3, the cradle 40 is positioned so that its lowest point is only slightly above the surface. In this way, when the cylinder 28 is resting in the cradle 40, an object support thereon will as close to the surface as possible. This reduces the total height of the apparatus 10 with an object (not shown in FIG. 3) supported on it in the horizontal position. This allows the loaded apparatus to fit easily under the sides of a truck where the clearance typically is only about 12 to 14 inches.

Figure 4:
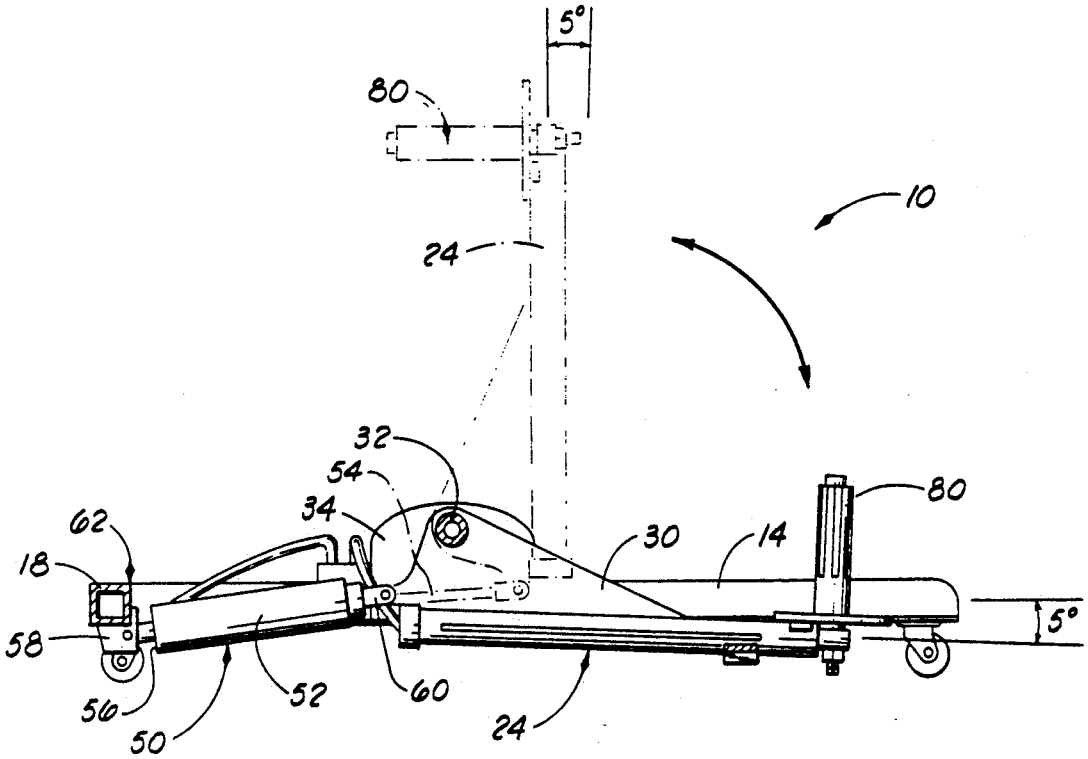
FIG. 4 is a side elevational view of the apparatus. The horizontal position of the support member is shown in solid lines. The forwardmost vertical position of the support member is shown in phantom lines. The proximal side of the frame is cut away.

The vertical rotation of the first hydraulic cylinder assembly 24, illustrated in FIG. 4, preferably is driven by a second hydraulic cylinder assembly 50. This second hydraulic cylinder assembly 50 also comprises a cylinder 52 and a rod 54. The base 56 of the cylinder 52 is pivotally attached to the end member 18 by a suitable joint 58. Similarly, the end of the rod 54 is pivotally attached to the end of the fin 30 on the cylinder 28 by a joint 60 of some type.

With continued reference to FIG. 4, the lengths and positioning of the cylinder assemblies 24 and 50 preferably are selected to provide a range of rotation for the first cylinder assembly through an arc of more than 90 degrees, the plane of the frame 12 being considered level or 180 degrees.

The first cylinder assembly 24 moves from a first position which is generally horizontal. Although referred to as horizontal relative to the surface, the first position preferably is slightly (about five degrees) below the level of the frame 12, as the pivot point on the cross bar 32 supports the end of the cylinder 28 at a point slightly higher than the free end of the cylinder when it is resting in the cradle 40. This reduces the overall height of the loaded apparatus for the reasons discussed.

Referring still to FIG. 4, when the rod 54 of the second cylinder assembly 50 is extended, the first cylinder assembly 24 is lifted to a generally vertical position. Although referred to as vertical relative to the surface, the first cylinder assembly 24 is movable to a second position slightly (about five degrees) past a perfectly (90 degrees) vertical position and tilts forward slightly towards the closed or second end 62 of the frame 12. As will discussed in more detail below, this forward tilt feature is an advantage in moving and positioning the object. The second hydraulic cylinder assembly 50 may be operated to selectively position the first hydraulic cylinder assembly 24 at any point between the first and second positions.

Figure 5:
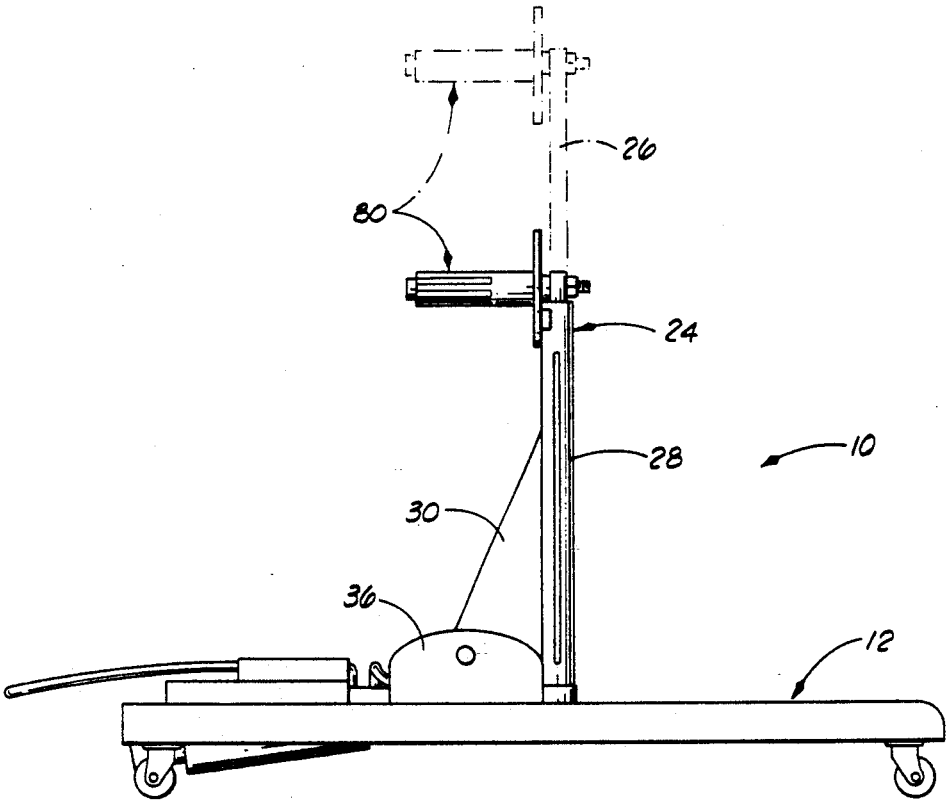
FIG. 5 is side elevation view of the apparatus with the support member in a vertical position. The lowest or completely retracted position is shown in solid lines. The highest or fully extended position is shown in phantom lines.

Turning now to FIG. 5, there is shown therein the operation of the support member, which in this embodiment is the first hydraulic cylinder assembly 24. The rod 26, in typical fashion, extends and retracts relative to the cylinder 28 so that the overall length of the assembly 24 is increased or decreased. Accordingly, an object (not shown in FIG. 5) supported on the free end of the rod 26 will be raised and lowered as the rod is extended and retracted.

In this regard, it should be noted that where hydraulic cylinders are used, as in this embodiment, cylinders of sufficient power to lift and move objects in excess of 200 pounds should be chosen. In addition, the length of the cylinder which serves as the support member should be chosen to support the object at the appropriate distance from the surface.

For example, in large trucks the crank shaft is usually about 30 to 36 inches from the ground. Thus, where the apparatus is to be used to install and remove clutches and flywheels on large trucks, the support cylinder preferably supports the object at about 29 inches from the ground when the rod is retracted and extends to support the object about 42 inches from the ground when the rod is fully extended. A variety of suitable hydraulic cylinder assemblies are commercially available.

Returning to FIGS. 1 and 2, the controls for the hydraulic cylinder assemblies 24 and 50 may be conveniently supported on the inside of the frame 12. To this end, a shelf 64 may be provided on the frame 12 for supporting the hydraulic control mechanism 66, which preferably is manually operable by either foot or hand action. Fluid from the control mechanism 66 is fed by the line 68 to a valve box 70 also mounted on the frame 12. The valve box 70 contains a three-way valve mechanism whereby fluid can be selectively directed to either the first hydraulic cylinder assembly 24 by the line 72 or the second hydraulic cylinder assembly 50 by the line 74. The control mechanism 66 preferably is removably supported on the shelf 64 so that it can be repositioned during operation of the device. However, in most instances it will be desirable to attach the valve box 70 permanently to the frame 12.

Figure 6:
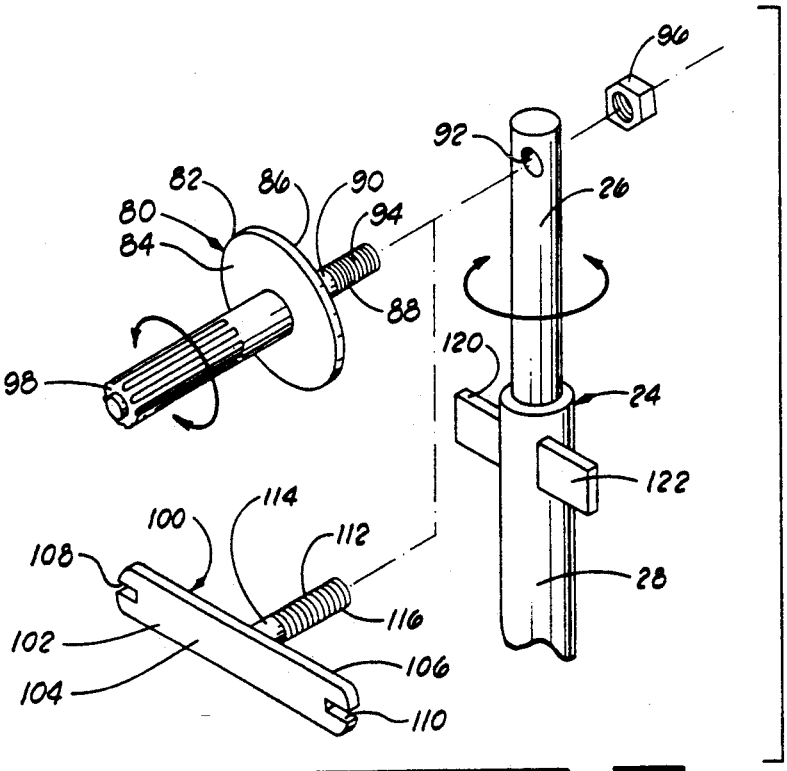
FIG. 6 is a fragmented, exploded perspective view of the upper end of the support member and illustrating two adaptors that may be used to secure objects to the end of the rod.

Attention now is directed to FIG. 6 which depicts two adaptors which may be used to secure objects to the end of the rod 26 of the first hydraulic cylinder assembly 24, which is shown only in part. A first adaptor 80 is designed for use with a clutch assembly. (See FIG. 1.) The adaptor 80 comprises a plate 82 having a front side 84 and a back side 86. A connector 88 extends from the back side 86 of the plate 82. The connector 88 has a straight cylindrical portion 90 sized to be received in the hole 92 in the end of the rod 26. A threaded portion 94 extends from the straight portion 90 and is sized for use with a nut 96.

A splined stem 98 extends from the front side 84 of the plate 82. The splined stem 98 is sized to engage the splined center hole of the clutch assembly (not shown). In this regard it will be noted that clutches are available in at least two sizes —those with a 1¾ inch spline and those with a 2 inch spline. Thus, it is necessary to provide the adaptor 80 with a splined stem 98 sized to engage the size of clutch which is being lifted or moved. For securing flywheels to the apparatus 10, a second adaptor 100 is used. This adaptor comprises a flat cross bar 102 having a front side 104 and a back side 106. The ends of the cross bar 102 define notches 108 and 110 for attaching the flywheel. A connector 112, like the connector 88 on the first adaptor 80, extends from the back side 106 of the cross bar 102. The connector 112 has a straight portion 114 and a threaded portion 116. The connector 112 is receivable in the hole 92 in the rod 26 and secured with the nut 96 in the same manner as the first adaptor 80.

Now it will be appreciated that while the object (be it a flywheel or a clutch assembly) is secured to the rod 26, the object can be rotated in a vertical plane as the straight portion 90 of the connector 80, or the straight portion 114 of the connector 112, is turned inside the hole 92 in the rod 26. That is, either of the connectors 80 and 112 turning in the rod 26 permits the object supported thereon to be rotated in a plane generally parallel to the longitudinal axis of the rod 26.

Still further, the object may be rotated in a circular manner as the rod 26 rotates axially in the cylinder 28. That is, the object can be rotated in a plane that is generally perpendicular to the longitudinal axis of the rod 26.

While the circular rotation is advantageous during removal or installation of the object, as discussed below, the circular movement can be dangerous during the movement of the object from the horizontal to the vertical position. For example, in the case of a clutch assembly, as the first hydraulic cylinder assembly 24 rises, the weight of the clutch will cause it to roll around on the rod 26 and to slip off the splined stem 98 of the adaptor 80.

To avoid this hazard, a pair of ears 120 and 122 are rigidly attached at the top of the cylinder 28. As best shown in FIG. 5, the ears 120 and 122 are positioned and sized to limit the circular movement of the adaptor 80 by engaging the plate 82 when the rod 26 is completely retracted. However, as is shown in phantom lines in FIG. 5, when the rod 26 is at least partially extended, the plate 82 clears the ears 120 and 122 and is free to rotate around the rod. It will be appreciated that in practicing this invention the splined stem 98 of the adaptor 80 may be modified to support other objects, and that the ears for limiting rotation of the adaptor will serve equally well with any such modified adaptor.

As indicated, the present invention is particularly suitable for removing and installing clutch assemblies and flywheels from large trucks. By way of example, the operation of the invention to remove and install a clutch assembly now will be described.

First, the proper adaptor is selected and attached to the end of the rod 26 while the first hydraulic cylinder assembly 24 is in the horizontal position. For example, in the case of a clutch with a two inch spline, an adaptor 80 with a two inch splined stem is selected.

Next, the apparatus with the hydraulic mechanism resting on the shelf is rolled under the truck beneath and behind the clutch assembly. The three-way valve is adjusted to direct the fluid to the second hydraulic cylinder assembly 50 and the hydraulics are activated. Extension of the rod 54 of the second cylinder 52 is continued until the first hydraulic cylinder assembly 24 is in a vertical position.

Next, the valve is switched to the first hydraulic cylinder assembly 24 and the rod 26 is extended until the splined stem 98 is adjacent the center hole of the clutch assembly. It may be necessary to rotate the adaptor 80 circularly to match the angle of the clutch. It may be necessary to further adjust the vertical angle of the rod 26 so that it tilts forward more or less. Usually it will be necessary to rotate the adaptor 80 in the rod 26 until the splines match the grooves in the clutch so that the clutch will slide onto the adaptor.

With the adaptor 80 properly positioned, the clutch is pulled back onto the splined stem 98 and, if necessary, the first hydraulic cylinder assembly 24 then is rotated backwards slightly so as not to be tilted forward. The rod 26 then is retracted and the cylinder 28 is returned to its horizontal position. Because of the ears 120 and 122, the clutch may roll slightly from side to side as it lowered into the cradle 40, but it will not roll to the underside of the rod 26. The apparatus 10 with the clutch mounted thereon but in the horizontal position is then pulled out from under the truck. The installation of a clutch is accomplished by performing these steps in reverse.

The removal and installation of a flywheel is similar. The flywheel adaptor 100 is attached to the rod 26 and the apparatus is positioned adjacent the flywheel under the truck. The flywheel is then secured to the adaptor 100 by bolting it to the notches 108 and 110 and the flywheel is lowered and removed. The replacement or installation of a flywheel is carried out in reverse.

It will now be recognized that the present invention provides many advantageous in the lifting and moving of heavy objects and, in particular, in the manipulation of clutches and flywheels underneath large trucks. The support member of the present invention can be positioned immediately adjacent the part and aligned vertically and horizontally to the precise angle at which the part is mounted in the truck. In this manner, movement of the part on to and off of the adapter is greatly facilitated.

Because the apparatus is so compact it slides easily under any truck, even with a large clutch assembly supported on it. Still further, because the support member is so narrow when in the vertical position, the apparatus leaves sufficient room in the space between the frame for the operator to stand and to manipulate the part as needed to move it off and on the adaptor. Yet, there is never any need for the operator to bear the full weight of the part.

Changes may be made in the combination and arrangement of the various parts, elements, steps and procedures described herein without departing from the spirit and scope of the invention as defined in the following claims.

What is claimed is:

1. An apparatus for moving and lifting an object over a surface, comprising:

a frame;

an elongate support member having an upper portion and a lower portion;

wherein the lower portion of the support member is attached to the frame for pivotal movement of the support member in a vertical plane between a first position in which the support member is generally horizontal and a second position in which the support member is generally vertical;

means for securing the object to the upper portion of the support member, such means comprising: an adapter comprising a plate with two sides; means on one side of the plate for securing the object to the adaptor; and a connector extending from the other side of the plate for attaching the adaptor to the upper portion;

wherein the upper portion and the lower portion of the support member are constructed so that the upper portion may be retracted and extended relative to the lower portion whereby the length of the support member is decreased and increased for raising and lowering the object;

wherein the upper portion of the support member and the means for securing the object to the upper portion of the support are characterized as permitting the object, while secured to the upper portion, to be rotated in a first plane generally perpendicular to the longitudinal axis of the support member;

means for limiting the range of rotation of the object in the plane perpendicular to the longitudinal axis of the support member while it is secured to the upper portion of the support member and while the upper portion is retracted relative to the lower portion, such means comprising a pair of ears extending from the sides of the support member and positioned thereon so that when the upper portion is retracted the ears engage the plate when the adapter is rotated to either side of the support member and so that when the upper portion is at least partially extended the plate clears the ears and a full range of rotation is permitted;

means for driving the retraction and extension of the upper portion relative to the lower portion of the support member; and means for driving the pivotal movement of the support member relative to the frame and for selectively positioning the support member at any point between the first position and the second position.

2. The apparatus of claim 1 wherein the means for driving the retraction and extension of the upper portion relative to the lower portion of the support member comprises a hydraulic mechanism.

3. The apparatus of claim 2 wherein the means for driving the pivotal movement of the support member relative to the frame comprises a hydraulic mechanism.

4. The apparatus of claim 1 wherein the means for driving the pivotal movement of the support member relative to the frame comprises a hydraulic mechanism.

5. The apparatus of claim 1 wherein the frame has a first end and a second end, wherein the frame defines a plane which is generally parallel to the surface, wherein the support member rotates through an arc of more than 90 degrees so that when the support member is in the first position the upper portion is supported generally in the first end of the frame and so that when the support member is in the second position the upper portion of the support member tilts slightly past a perfectly vertical position relative to the frame towards the second end of the frame.

6. The apparatus of claim 1 wherein the means for securing the object to the upper portion of the support member is characterized as permitting the object, while secured to the upper portion, to be rotated in a plane generally parallel to the longitudinal axis of the support member.

7. An apparatus for moving and lifting an object over a surface, comprising:

a frame;

an elongate support member having an upper portion and a lower portion;

wherein the lower portion of the support member is attached to the frame for pivotal movement of the support member between a first position in which the support member is generally horizontal and a second position in which the support member is generally vertical;

means for securing the object to the upper portion of the support member, which means is characterized as permitting an object positioned on the upper portion to be rotated in a first plane generally perpendicular to the longitudinal axis of the support member and in a second plane generally parallel to the longitudinal axis of the support member and generally perpendicular to the plane defined by the rotation of the support member relative to the frame, and which means comprises an adapter having a plate with two sides, with means on one side of the plate for securing the object to the adapter and with a connector extending from the other side of the plate for attaching the adapter to the upper portion of the support member;

wherein the upper portion and the lower portion of the support member are constructed so that the upper portion may be retracted and extended relative to the lower portion whereby the length of the support member is decreased and increased for raising and lowering the object;

means for limiting the range of rotation of the object while it is secured to the upper portion of the support member and while the upper portion is retracted relative to the lower portion, which means comprises a pair of ears extending from the sides of the support member and positioned thereon so that when the upper portion is retracted the ears engage the plate when the adapter is rotated to either side of the support member and so that when the upper portion is at least partially extended the plate clears the ears and a full range of rotation is permitted;

means for driving the retraction and extension of the upper portion relative to the lower portion of the support member; and means for driving the pivotal member of the support member relative to the frame.

8. The apparatus of claim 7 wherein the means for driving the retraction and extension of the upper portion relative to the lower portion of the support member comprises a hydraulic mechanism.

9. The apparatus of claim 8 wherein the means for driving the pivotal movement of the support member relative to the frame comprises a hydraulic mechanism.

10. The apparatus of claim 7 wherein the means for driving the pivotal movement of the support member relative to the frame comprises a hydraulic mechanism.

11. The apparatus of claim 7 wherein the frame has a first end and a second end, wherein the frame defines a plane which is generally parallel to the surface, wherein the support member rotates through an arc of more than 90 degrees so that when the support member is in the first position the upper portion is supported generally in the first end of the frame and so that when the support member is in the second position the upper portion of the support member tilts slightly past a perfectly vertical position towards the second end of the frame.

12. An apparatus for moving and lifting an object over a surface, comprising:

a wheeled frame;

a first hydraulic cylinder assembly comprising a rod and a cylinder;

wherein the cylinder of the first hydraulic cylinder assembly is pivotally attached to the frame for selective movement in a vertical plane between a first position in which the cylinder is substantially horizontal and a second position in which the cylinder is substantially vertical;

means for securing the object to the free end of the rod of the first hydraulic cylinder assembly, which securing means is characterized as permitting the object secured thereby to be rotated in a first plane generally parallel to the longitudinal axis of the rod, which securing means is further characterized as permitting an object secured thereby to be rotated in a second plane generally perpendicular to the longitudinal axis of the rod and generally perpendicular to the plane defined by the rotation of the first hydraulic cylinder assembly relative to the frame, and which securing means comprises an adapter having a plate with two sides, with means on one side of the plate for securing the object to the adapter and with a connector extending from the other side of the plate for attaching the adapter to the upper rod of the first hydraulic cylinder assembly; and wherein when the first hydraulic cylinder assembly is in a generally vertical position, the rod of the first hydraulic cylinder assembly can be extended and retracted to raise and lower the object secured thereto;

means for limiting the range of rotation of the object in the second plane perpendicular to the longitudinal axis of the first hydraulic cylinder while the object is secured to the rod of the first hydraulic cylinder assembly and while the rod of the first hydraulic assembly is retracted relative to the cylinder, which means comprises a pair of ears extending from the sides of the end of the cylinder from which the rod extends so that when the rod is retracted the ears engage the plate when the adapter is rotated to either side of the cylinder and so that when the rod is at least partially extended the plate clears the ears and full range of rotation is permitted; and a second hydraulic cylinder assembly comprising a cylinder and a rod for driving the movement of the first hydraulic cylinder assembly between the first position and the second position and for selectively positioning the first hydraulic cylinder assembly at any point therebetween.

13. The apparatus of claim 12 wherein the frame has a first end and a second end, wherein the frame defines a plane which is generally parallel to the surface, wherein the first hydraulic cylinder assembly rotates through an arc of more than 90 degrees from the plane of the frame so that when the first hydraulic cylinder assembly is in the first position the free end of the rod of the first hydraulic cylinder assembly is supported generally in the first end of the frame and so that when the first hydraulic cylinder assembly is in the second position the free end of the rod of the first hydraulic cylinder assembly tilts slightly past a vertically vertical position and towards the second end of the frame.

14. The apparatus of claim 1 wherein the frame is wheeled.

15. The apparatus of claim 7 wherein the frame is wheeled.

* * * * *

UNITED STATES PATENT AND TRADEMARK OFFICE

CERTIFICATE OF CORRECTION

PATENT NO. : 5,297,915

DATED : March 29, 1994

INVENTOR(S) : Francis L. Bach

It is certified that error appears in the above-identified patent and that said Letters Patent is hereby corrected as shown below:

Column 2, line 57, delete the word "makes."

Column 3, line 38, the word "support" should be -- supported --.

Column 3, line 39, after the word "will" insert the word -- be --.

Column 4, line 11, after the word "will" insert the word -- be --.

Column 6, line 40, the word "advantageous" should be -- advantages --.

Column 8, line 51, the word "member" should be -- movement --.

Column 10, line 32, the word "vertically" should be -- perfectly --.

Signed and Sealed this

Thirtieth Day of August, 1994

Bruce Lehman

*Attest:*

BRUCE LEHMAN

*Attesting Officer*

*Commissioner of Patents and Trademarks*